United States Patent [19]

Hansen et al.

[11] Patent Number: 4,808,301

[45] Date of Patent: Feb. 28, 1989

[54] FLOTATION DEPRESSANTS

[75] Inventors: Robert D. Hansen; Richard R. Klimpel, both of Midland, Mich.

[73] Assignee: The Dow Chemical Company, Midland, Mich.

[21] Appl. No.: 116,757

[22] Filed: Nov. 4, 1987

[51] Int. Cl.[4] ..... B03D 1/02

[52] U.S. Cl. ..... 209/167; 252/61

[58] Field of Search ..... 209/167, 166; 252/61; 75/2

[56] References Cited

U.S. PATENT DOCUMENTS 4,339,331 7/1982 Lim ..... 209/167

4,482,480 11/1984 Bresson ..... 209/167

*Primary Examiner*—Kenneth M. Schor

*Assistant Examiner*—Thomas M. Lithgow

*Attorney, Agent, or Firm*—Paula S. Ruhr

[57] ABSTRACT

The flotation of desired mineral ores is selectively depressed by the use of an effective amount of a polycarboxylic acid or salt thereof in a reverse flotation process. As an example, the flotation of iron-containing minerals, such as iron oxides or iron powder, is selectively depressed when compared to the flotation of silicate gangue thus facilitating the recovery of the desired mineral by the use of an effective amount of a polycarboxylic acid or salt thereof such as sodium polyacrylate.

12 Claims, No Drawings

FLOTATION DEPRESSANTS

BACKGROUND OF THE INVENTION

This invention relates to processes for the separation of desirable minerals from undesirable minerals.

In the processing of mineral-containing ores, it is necessary to remove undesirable minerals called gangue from the desired minerals. One method of accomplishing this goal is to depress the flotation of a particular mineral during the normal flotation process. In mineral flotation systems, it is common to depress or hold down the undesirable gangue materials while floating the desirable mineral or minerals. In differential or reverse flotation systems, it is common to depress or hold down the desired mineral or minerals while floating the undesirable gangue. That is, the normal flotation system where the desired mineral or minerals are floated and the gangue remains behind is reversed.

In a typical ore flotation scheme, the ore is ground to a size sufficiently smaller to liberate the desired mineral or minerals from the undesired gangue. An additional step in the flotation process involves the removal of the ultra-fine particles by desliming. Ultra-fine particles are generally defined as those less than 5 to 10 microns in diameter. The desliming process may be accompanied by or followed by a flocculation step or some other type of settling step such as the use of a cyclone separating device. This step is followed by a flotation step wherein gangue materials are separated from the desired mineral or minerals in the presence of collectors and/or frothers.

Depression is conventionally accomplished by the use of one or more depressing agents during the flotation step. The depressing agent or the depressant, when added to the flotation system, exerts a specific action on the material to be depressed thereby preventing it from floating. Various theories have been put forth to explain this phenomenon. Some of these include: that the depressants react chemically with the mineral surface to produce insoluble protective films of a wettable nature which fail to react with collectors; that the depressants, by various physical-chemical mechanisms, such as surface adsorption, mass-action effects, complex formation or the like, prevent the formation of the collector film; that the depressants act as solvents for an activating film naturally associated with the mineral; and that the depressants act as solvents for the collecting film. These theories appear closely relaed and the correct theory may eventually be found to involve elements of most or all of these and more.

It has been conventional in non-sulfide flotation systems to use naturally derived substances such as starches, dextrins and gums as depressants. However, the presence of these substances in waste water streams increases the biodegradable oxygen demand and the chemical oxygen demand and therefore creates pollution control problems. Further, in some countries, there is a prohibition against using substances such as starch which have food value in this type of commercial application. In addition, starch-type depressants require complex preparation of the reagent which results in the reagent being susceptible to bacterial decomposition and therefore monitoring of the reagent is required during storage.

Synthetic depressants have been developed that are generally useful in the separation of gangue from desirable minerals. U.S. Pat. Nos. 4,360,425 and 4,289,613 describe the use of low molecular weight polymers, copolymers and terpolymers as depressants in mineral ore flotation. U.S. Pat. No. 2,740,522 describes the use of water-soluble, anionic, linear, addition polymers of a monoethylenically unsaturated compound and the water-soluble salts thereof to depress the flotation of gangue. U.S. Pat. Nos. 3,929,629 teaches that polymers of water soluble acrylamide homopolymers or copolymers thereof with acrylic or methacrylic acid or salts thereof are useful as gangue depressants in froth flotation processes designed to treat cassiterite ore.

One of the problems associated with existing depressants is that the depressants have differing levels of effectiveness depending on the conditions under which they are used and the mineral and gangue which are to be separated. What is needed are depressants which, while generally useful in mineral processing, meet specific needs which exist within the mining industry. Further, what is needed are depressants which effectively depress the flotation of desired mineral or minerals in reverse flotation processes.

An additional problem exists concerning the use of depressants in reverse or differential flotation systems. Because no system for depressing minerals is ideal, some portion of the desired minerals will be inadvertently floated away with the gangue. That portion of the valuable mineral or minerals that is inadvertently removed with the gangue is normally permanently lost from the process and can have a significant economical impact. Even a small decrease in the amount of desired mineral or minerals which are inadvertently floated with the gangue can therefore result in significant economical benefits. Thus, what is particularly needed are depressants useful in reverse flotation systems that depress the flotation of the desired mineral or minerals to a significant degree while having minimal effect of the flotation of related gangue.

SUMMARY OF THE INVENTION

This invention is such a process for the depression of desired mineral or minerals in a flotation process. This process comprises adding to the flotation system an effective amount of a polycarboxylic acid or salt thereof to depress the flotation of one or more desired minerals thus facilitating the separation of the minerals from undesirable gangue. The process is particularly useful in the separation of iron oxide minerals from silicates and related gangue in flotation processes using non-sulfide collectors.

The polycarboxylic acids or salts thereof of this invention surprisingly selectively depress iron oxide minerals in comparison to silicates and associated gangue.

DETAILED DESCRIPTION OF THE ILLUSTRATIVE EMBODIMENTS

Polycarboxylic acids or salts thereof useful in the practice of this invention include any inherently liquid-dispersible polyelectrolyte having a hydrocarbon backbone bearing a plurality of pendant carboxylic groups.

Preferred polycarboxylate acids include the water-dispersible polymers or salts thereof of anionic monomers such as $\alpha,\beta$-ethylenically unsaturated acids including, as examples, acrylic, methacrylic, fumaric, maleic, crotonic, itaconic, or citraconic acids and partial esters of $\alpha,\beta$-ethylenically unsaturated polycarboxylic acids such as methyl acid maleate, ethyl acid fumarate. It is more preferred that the polycarboxylic acid be a polymer of acrylic acid. When the polymer is in the salt form, it is preferred that the counterion is a Group I metal ion or an ammonium ion. It is more preferred that the counterion be Na or K. It is most preferred that polycarboxylic acid be in a salt form and be sodium polyacrylate.

The polycarboxylic acids or salts thereof useful in the practice of this invention may be of any molecular weight so long as they have the effect of depressing the flotation of the desired minerals in preference to depressing the flotation of the associated gangue and so long as they possess essentially no flocculating properties. There is, in effect, no lower limit on the molecular weight as very small molecules have a depressing effect. It is preferred that the molecular weight be no greater than about 100,000, and it is more preferred that the molecular weight be no greater than about 50,000. It is preferred that the molecular weight be at least about 500 and more preferred that it be at least about 2000. It is most preferred that the molecular weight of the polycarboxylic acid or salt thereof be between about 4000 and about 10,000.

Any amount of depressant which will depress the flotation of the desired mineral ore or ores may be used in the practice of this invention. Generally, the amount of depressant needed will vary depending on the desired mineral and gangue to be separated and the conditions of flotation process. It is preferred that at least about 0.01 kilogram of depressant is used per metric ton of ore to be floated. It is more preferred that at least 0.05 kilogram of depressant is used per metric ton of ore to be floated. It is preferred that no more than about 1 kilogram of depressant is used per metric ton of ore to be floated and more preferred that no more than about 0.5 kilogram of depressant be used per metric tone of ore to be floated.

The depressant may be added at any stage of the separation process so long as it is added prior to the flotation step. It is preferred to add the depressant before or with the addition of the collector.

The depressants useful in the practice of this invention are effectve when used in conjunction with a wide variety of collectors. It is preferred to use collectors containing oxygen and nitrogen. It is more preferred to use amine collectors. The choice of collector will depend on the particular ore to be processed and on the type of gangue to be removed.

The polycarboxylic acids and salts thereof of this invention are generally useful as depressants in mineral flotation. However, they are far more effective in depressing the flotation of some minerals than of others and the recognition of this difference allows the use of these depressants to separate desirable minerals from gangue. In particular, the polycarboxylic acids and salts thereof of this invention are effective in selectively depressing desired mineral(s) as compared to gangue. Examples of mineral ores which are depressed in the presence of the polycarboxylic acids and salts thereof of this invention include iron powder, hematite ($Fe_2O_3$), magnetite ($Fe_3O_4$), pyrite ($FeS_2$), chromite ($FeCr_2O_4$), goethite ($\alpha$-FeO.OH), pyrrohotite ($Fe_{1-x}S$) or any other iron-containing minerals. It is preferred that the polycarboxylic acids and salts thereof of this invention are used to depress the flotation of iron powder, goethite, hematite or magnetite.

In a preferred embodiment, the polycarboxylic acid depressants of this invention are used to enhance the separation of iron-containing minerals, preferably iron oxides or iron powder, from silicate gangue by differentially depressing the flotation of the iron-containing minerals relative to that of the silicate gangue. One of the problems associated with the separation of iron-containing minerals from silicate gangue is the tendency of iron-containing minerals and silicates to float under similar conditions. Thus, the process of this invention is directed to a method of enhancing the different characteristics of iron-containing minerals as compared to silicate gangue.

The degree to which iron-containing minerals are depressed may be any which will allow a reasonable separation of the iron from the silicate gangue. The degree of depression obtained is calculated by measuring the weight percent of the particular mineral or gangue floated in the absence of any depressant and measuring the weight percent floated in the presence of a depressant. The latter value is subtracted from the former; the difference is divided by the weight percent floated without any depressant; and this value is multiplied by 100 to obtain the percent of depression. It is preferred that the flotation of iron-containing minerals be depressed by at least about 5 percent by the use of the depressant in the flotation process under conditions closely approximating those existing in acute mineral processing. It is more preferred that it be depressed by at least about 10 percent and most preferred that it be depressed by at least about 12 percent. It is preferred that the flotation of the silicate gangue be depressed by no more than about 7.5 percent. It is more preferred that the flotation of silicate gangue be depressed by no more than about 5 percent.

The following examples are provided by way of illustration and are not given to limit the invention in any way. Unless stated otherwise, all parts and percentages are given by weight.

EXPERIMENTAL PROCEDURE FOR EXAMPLES 1–16

The following general procedure is used in Experiments 1–16 to determine, under laboratory conditions, the depressant effect of sodium polyacrylate on hematite and silicates.

A 150-ml portion of deionized water is placed in a 250-ml glass beaker. A 2.0-ml of a 0.10 molar solution of potassium nitrate is added as a buffer electrolyte. The solution is adjusted to a pH of 10 with addition of 0.10N HCl and 0.10N NaOH. Next, 1.00 g of the mineral to be tested is added.

Additional deionized water is added to the slurry. In those experiments where it is desired to determine the effect of the depressant in water containing calcium ions, a sufficient amoun of an 11.1 percent solution of calcium chloride to bring the concentration of calcium ions to about 1000 ppm is added to the slurry and the addition is followed by a five-minute conditioning period. This addition is followed by the addition of 0.2 ml of a 1.0 percent solution of the sodium polyacrylate depressant in water and another five-minute conditioning period. Under these laboratory conditions, a high concentration of depressant is required due to the use of pure minerals. Finally, about 1.0 ml of the collector is added, again followed by a five minute conditioning period. During conditioning, the pH is monitored and adjusted if necessary with 0.10N HCL and 0.10N NaOH. The final slurry volume after all the additions is 180 ml.

The slurry is transferred into a Hallimond tube redesigned to allow a hollow needle to be fitted at the base of the 180-ml tube so that air bubbles can enter the slurry. A plastic cap is also fitted on the descending arm to collect the floated material.

After the slurry is transferred to the Hallimond tube, a vacuum of five inches of mercury is applied to the opening of the tube for a period of ten minutes. This vacuum allows the air bubbles to enter through the hollow needle inserted at the base of the tube. During the flotation, the minerals are agitated with a magnetic stirrer set at 200 rpm.

The floated and unfloated material is filtered out of the slurry and dried in an oven at 100° C. and then it is weighed.

After each test, all equipment is washed with concentrated HCL and rinsed with 0.10N NaOH and deionized water.

EXAMPLES 1-10

Table I represents data obtained using the procedure described above. In each case, a "1.00" would represent all of the mineral floating. Thus, an entry of 0.75 means that 75 percent of the mineral present was floated. The percentage reduction in flotation is determined as follows:

$$((A-B)/A)\times 100$$

wherein A represents the amount of mineral floated without the addition of the sodium polyacrylate depressant and B represents the amount of mineral floated with the addition of the sodium polyacrylate depressant.

TABLE I

| Collector | Silica Floated a | Silica Floated b | Silica Floated c | Hematite Floated a | Hematite Floated b | Hematite Floated c |
|---|---|---|---|---|---|---|
| (1) $R(CO)NH(CH_2)_2N(CH_2)_2OH$ <br> $\lvert$ <br> $(CH_2)_2COOH$ <br> R = tall oil | 0.93 | 0.76 | 18 | 0.36 | 0.05 | 86 |
| (2) As in (1) above <br> R = coconut oil | 0.97 | 0.48 | 50 | 0.43 | 0.04 | 91 |
| (3) $C_9H_{19}O(CH_2)_3NH_3$ | 0.89 | 0.74 | 17 | 0.29 | 0.20 | 31 |
| (4) $C_{11}H_{15}(CO)NH(CH_2)_2N(CH_2)_2OH$ <br> $\lvert$ <br> $(CH_2)_2COOH$ | 0.94 | 0.88 | 6 | 0.58 | 0.13 | 78 |
| (5) $C_{13}H_{27}O(CH_2)_3N(CH_2)_3NH_2$ <br> $\lvert$ <br> $(CH_2)_2COOH$ | 0.96 | 0.89 | 7 | 0.53 | 0.26 | 51 |
| (6) $C_{18}H_{37}(CO)NH(CH_2)_2NH(CH_2)_2COOH$ | 0.96 | 0.74 | 23 | 0.72 | 0.18 | 75 |
| (7) $C_{13}H_{27}O(CH_2)_3N(CH_2)_3\quad N(CH_2)_2COOH$ <br> $\lvert\qquad\qquad\lvert$ <br> $(CH_2)_3COOH\ (CH_2)_2COOH$ | 0.98 | 0.99 | −1 | 0.91 | 0.12 | 89 |
| (8) $CH_3(CH_2)_3CH{=}CH(CH_2)_7COOH$ | 0.97 | 0.85 | 12 | 0.98 | 0.29 | 70 |
| (9) $C_{15}H_{31}O(CH_2)_3NH(CH_2)_3NH_2$ | 0.97 | 0.63 | 35 | 0.62 | 0.13 | 79 |
| (10) $C_{12}H_{25}NH_2$ | 0.96 | 0.75 | 22 | 0.97 | 0.15 | 85 |

a — 1000 ppm $Ca^{++}$
b — 1000 ppm $Ca^{++}$ and 2.0 kg/metric ton sodium polyacrylate solution
c — % decrease in flotation with addition of sodium polyacrylate The data presented in Table I demonstrates the effectiveness of sodium polyacrylate as a general depressant. In each case, hematite is depressed significantly more than silica. As discussed above, the data in Table I was obtained under laboratory conditions.

EXAMPLES 11-30

Depressant Effect of Sodium Polyacrylic on the Flotation of Hematite and Silica Iron ore samples from Northern Michigan are divided into 600-g lots. The samples are essentially +100 mesh (+149 micron) material obtained through screening of a split mine sample followed by size reduction to −10 mesh (=2 mm) using staged rolled crushing. The samples are then ground in an 8-inch by 10-inch rod mill containing 26 rods in varying diameter as follows:

two 1.25 inches,
eight 0.75 inch,
four 0.5 inch,
ten 0.375 inch, and
two 0.25 inch.

The total weight of the rods is between 9350 g and 9450 g.

Each sample is charged into the mill with 400 ml of reuse mill water to obtain a pulp density of 60 weight percent solids. Next, 0.447 kg/metric ton (solid weight basis) of NaOH solution and 0.0447 kg/metric ton (solid weight basis) of sodium silicate solution are added and the sample is ground for 43 minutes by rotating the mill at a constant speed of 54 revolutions per minute.

After the completion of grinding, the pulp is washed from the mill and diluted in an eight-liter deslime vessel to about 7 weight percent solids using reuse mill water. The pH of the mineral suspension is monitored and maintained at greater than about 10.0 by the addition of 0.10N NaOH or 0.10N HCl, as necessary. Then, 0.11 kg/metric ton (solid weight basis) of pearl starch solution is added to the pulp and the pulp is conditioned for two minutes using a plunger. The pulp is allowed to settle for 15 minutes and then the supernatant slimes are siphoned off down to the 0.2 liter level mark.

The deslimed flocculated pulp is transferred to a Wemco flotation cell and diluted to about 2500 ml with reuse mill water adjusted to a pH level of 11.0 by the addition of 0.10N NaOH or 0.10N HCl, as necessary. Next, 0.447 kg/metric ton (solid weight basis) of pearl starch solution is added to the pulp and the pulp is conditioned for two minutes. The temperature of the pulp is about 3° C. A specified amount of sodium polyacrylate in the form of a water solution is added to the pulp. Then, a specified amount of an alkyl ether amine collector is added to the pulp which is under agitation at a specified number of revolutions per minute (rpm). When the addition of the collector is complete, the air valve of the flotation machine is opened and the froth is removed and collected over about a three-minute period. The pulp remaining in the flotation cell (rougher concentrate) and the froth concentrate are filtered, dried, and weighed.

The data obtained in Examples 11–30 is presented in Table II below. As in Examples 1–10, an entry of 1.00 would indicate that all of the listed mineral floated. The percentage reduction in flotation is also determined as explained in Examples 1–10.

TABLE II

| Example | Collector (kg/metric ton) | Sodium Polyacrylate (kg/metric ton) | Agitation (rpm) | Silica a[1] | Silica b[2] | Hematite a[1] | Hematite b[2] |
|---|---|---|---|---|---|---|---|
| 11 | 0.16 | 0.0 | 1250 | .785 | — | .414 | — |
| 12 | 0.16 | 0.03 | 1250 | .742 | 5.5 | .390 | 5.8 |
| 13 | 0.16 | 0.07 | 1250 | .763 | 2.8 | .359 | 13.3 |
| 14 | 0.16 | 0.13 | 1250 | .758 | 3.4 | .371 | 10.4 |
| 15 | 0.16 | 0.20 | 1250 | .743 | 5.4 | .347 | 16.2 |
| 16 | 0.16 | 0 | 1500 | .766 | — | .374 | — |
| 17 | 0.16 | 0.03 | 1500 | .734 | 4.2 | .344 | 8.0 |
| 18 | 0.16 | 0.07 | 1500 | .751 | 2.0 | .334 | 10.7 |
| 19 | 0.16 | 0.13 | 1500 | .710 | 7.3 | .327 | 12.6 |
| 20 | 0.16 | 0.20 | 1500 | .744 | 2.9 | .316 | 15.5 |
| 21 | 0.16 | 0 | 1500 | .818 | — | .397 | — |
| 22 | 0.16 | 0.03 | 1500 | .820 | −0.2 | .385 | 3.0 |
| 23 | 0.16 | 0.07 | 1500 | .802 | 2.0 | .382 | 3.8 |
| 24 | 0.16 | 0.13 | 1500 | .800 | 2.2 | .357 | 10.1 |
| 25 | 0.16 | 0.20 | 1500 | .790 | 3.4 | .334 | 15.9 |
| 26 | 0.20 | 0 | 1250 | .804 | — | .419 | — |
| 27 | 0.20 | 0.03 | 1250 | .778 | 3.2 | .372 | 11.2 |
| 28 | 0.20 | 0.07 | 1250 | .776 | 3.5 | .365 | 12.9 |
| 29 | 0.20 | 0.13 | 1250 | .776 | 3.5 | .360 | 14.1 |
| 30 | 0.20 | 0.20 | 1250 | .795 | 1.1 | .365 | 12.9 |

[1]amount of mineral floated
[2]percent reduction in flotation with the addition of sodium polyacrylate The data shown in Table II demonstrates the depressant effect of varying amounts of sodium polyacrylate on the flotation of hematite and silica under conditions which closely approximate actual mineral processing conditions. The depressant effect on the flotation of hematite is significantly larger than the effect on the flotation of silica. The data also shows that the depressant effect on hematite generally increases as the amount of depressant used increases. In the case of silica, the amount of depressant used has no consistent effect on the degree of depression observed.

What is claimed is:

1. A process for concentrating iron-containing mineral values of an ore in a reverse flotation system which comprises subjecting said ore, having gangue material and said iron-containing mineral values, in the form of an aqueous slurry, to a froth flotation process with the addition to the flotation system of (1) a gangue material collector and (2) as a differential depressant for iron-containing mineral values, an effective amount of polyacrylic acid or a salt thereof to differentially depress the flotation of the iron-containing mineral values and recovering concentrated iron-containing mineral values from the flotation underflow.

2. The process of claim 1 wherein the polyacrylic acid or salt thereof has a molecular weight of about 100,000 or less.

3. The process of claim 2 wherein the polyacrylic acid or salt thereof has a molecular weight of about 25,000 or less.

4. The process of claim 2 wherein the polyacrylic acid or salt thereof has a molecular weight of between about 4000 and about 10,000.

5. The process of claim 1 wherein the polyacrylic acid is in salt form.

6. The process of claim 5 wherein the salt of the polyacrylic acid is sodium polyacrylate.

7. The process of claim 1 wherein the depressant is added to the flotation system at a level of between at least about 0.01 kilogram and no greater than about 1 kilogram of depressant per metric ton of ore treated.

8. The process of claim 7 wherein the depressant is present at a level of at least about 0.05 and no greater than about 0.5 kilogram of depressant per ton of ore treated.

9. The process of claim 1 wherein the flotation of iron-containing mineral is depressed by at least about 5 percent.

10. The process of claim 9 wherein the flotation of the iron-containing mineral is depressed by at least about 10 percent.

11. The process of claim 1 wherein the gangue material comprises silicate gangue.

12. The process of claim 11 wherein the flotation of the silicate gangue is depressed by no more than about 5 percent.

* * * * *